United States Patent [19]

Canaris

[11] Patent Number: 4,832,802

[45] Date of Patent: May 23, 1989

[54] ACID ZINC-NICKEL PLATING BATHS AND METHODS FOR ELECTRODEPOSITING BRIGHT AND DUCTILE ZINC-NICKEL ALLOYS AND ADDITIVE COMPOSITION THEREFOR

[75] Inventor: Valerie M. Canaris, Parma, Ohio

[73] Assignee: McGean-Rohco, Inc., Cleveland, Ohio

[21] Appl. No.: 206,017

[22] Filed: Jun. 10, 1988

[51] Int. Cl.[4] ..... C25D 3/56

[52] U.S. Cl. ..... 204/44.2; 204/DIG. 2

[58] Field of Search ..... 204/44.2, 44.5, DIG. 2

[56] References Cited

U.S. PATENT DOCUMENTS 4,740,277 4/1988 Klos et al. ..... 204/44.2

*Primary Examiner*—G. L. Kaplan

*Attorney, Agent, or Firm*—Renner, Otto, Boisselle & Sklar

[57] ABSTRACT

An aqueous acidic zinc-nickel plating bath is described. The plating baths generally comprise (A) zinc ions;

(B) nickel ions;

(C) an amount, sufficient to provide a level and bright zinc-nickel alloy electrodeposit, of at least one polymeric sulfur-containing compound having the general formula $$RS(R'O)_nH \quad (I)$$

or $$S\text{-}[(R'O)_nH]2 \quad (II)$$

wherein r is an alkyl group containing up to about 24 carbon atoms, each R′ is independently an alkylene group containing 2 or 3 carbon atoms, and each n is independently an integer of from 1 to about 100; and (D) a ductility-improviding amount of at least one acetylenic derivative obtained by sulfonating an intermediate obtained by (D-1) reacting an acetylenic alcohol or diol with a halogenated epoxide; or (D-2) reacting an acetylenic alcohol or diol with an alkylene oxide followed by reaction with a halogenated epoxide.

Preferably, additional additives are included in the plating baths to improve the properties of the deposited alloy. For example, aromatic carbonyl-containing compounds to improve the brightness of the alloy, and aromatic sulfonic acids or bath-soluble salts thereof are useful additive as solubilizers. The plating baths of the invention are effective over a wide current density range.

23 Claims, No Drawings

ACID ZINC-NICKEL PLATING BATHS AND METHODS FOR ELECTRODEPOSITING BRIGHT AND DUCTILE ZINC-NICKEL ALLOYS AND ADDITIVE COMPOSITION THEREFOR

TECHNICAL FIELD

This invention relates to the electrodeposition of a bright zinc-nickel alloy from an aqueous galvanic bath. More specifically, the invention relates to acidic zinc-nickel electroplating baths containing certain polymeric sulfur-containing compounds and certain acetylenic derivatives.

BACKGROUND OF THE INVENTION

Considerable attention has been paid to providing improved corrosion protection to metallic surfaces. One way of providing this corrosion protection is by electrodepositing a zinc coating on the surface. For decades, electroplated zinc has been used by the automotive industry to provide an economical, highly corrosion-resitant coating. However, with today's unprecedented demands for higher quality and extended warrantees, both the automotive manufacturers and their suppliers have had to develop new coatings. The best overall performance is being demonstrated by zinc-cobalt and zinc-nickel alloy platings. These alloys are being introduced as replacements for conventional zinc electroplates in automotive as well as other applications requiring extended corrosion-resistance. The term "alloy", as used in this specification and claims is defined as a mixture of two or more metallic elements which may be microscopically homogeneous or microscopically heterogeneous.

The improvement of zinc-nickel alloys has been demonstrated by superior salt spray performance when comparing zinc-nickel to zinc electrodeposits. The amount of nickel in the zinc-nickel electrodeposit that is useful for improved corrosion protection has been found to be from about 4% nickel to about 18% nickel with an optimum level of about 10% to 12%.

Typically, zinc-nickel alloy plating baths have been based on inorganic zinc and nickel salts such as zinc sulfate, zinc chloride, nickel sulfate or nickel chloride and contain various additives to improve the brightness and the grain structure of the deposit and provide control of the zinc to nickel ratio. These baths tend to give a dull to semi-bright electrodeposit and have a tendency to give a brittle deposit. There is a commercial advantage to be able to electrodeposit a mirror-bright deposit, similar to that achieved by nickel or chrome electrodeposits and to increase the ductility of the electrodeposit.

SUMMARY OF THE INVENTION

An aqueous acidic zinc-nickel plating bath is described. The plating baths generally comprise (A) zinc ions;

(B) nickel ions;

(C) an amount, sufficient to provide a level and bright zinc-nickel alloy electrodeposit, of at least one polymeric sulfur-containing compound having the general formula $$RS(R'O)_nH \quad (I)$$

or $$S—[(R'O)_nH]2 \quad (II)$$

wherein R is an alkyl group containing up to about 24 carbon atoms, each R' is independently an alkylene group containing 2 or 3 carbon atoms, and each n is independently an integer of from 1 to about 100; and (D) a ductility-improving amount of at least one acetylenic derivative obtained by sulfonating an intermediate obtained by (D-1) reacting an acetylenic alcohol or diol with a halogenated epoxide; or (D-2) reacting an acetylenic alcohol or diol with an alkylene oxide followed by reaction with a halogenated epoxide.

Preferably, additional additives are included in the plating baths to improve the properties of the deposited alloy. For example, aromatic carbonyl-containing compounds improve the brightness of the alloy, and aromatic sulfonic acids or bath-soluble salts thereof are useful additives as solubilizers. The plating baths of the invention are effective over a wide current density range.

DESCRIPTION OF THE PREFERRED EMBODIMENTS

The improved zinc-nickel alloy electroplating baths of the present invention comprise an aqueous solution containing zinc ions, nickel ions, and a mixture of components to brighten and ductilize the deposit. The baths also contain a concentration of hydrogen ions sufficient to impart an operating pH of from about zero to about 6.5. More generally, the plating baths will be operated at a pH of from about 4 to about 6.5. The acidity of the acid baths may be lowered, if desired, by the addition of acid solutions such as 10% sulfuric acid solution. If the pH falls below the desired operating range, it can be increased by the addition of ammonium hydroxide or potassium hydroxide.

The plating baths of the present invention generally will contain zinc ion at concentrations ranging from about 5 g/L to about 180 g/L with concentrations of about 10 g/L up to about 100 g/L being preferred. The zinc ion may be present in the bath in the form of a soluble salt such as zinc sulfate, zinc chloride, zinc fluoborate, zinc sulfamate, zinc acetate and zinc alkane sulfonic acid, e.g., zinc methane sulfonate. In addition, mixtures of the above salts may be used to provide the desired operating zinc ion concentration.

The nickel ions also are present in the aqueous plating bath in the form of aqueous soluble salts such as nickel chloride, nickel sulfate, nickel fluoborate, nickel acetate, nickel sulfamate and nickel alkane sulfonic acid salts, and mixtures thereof. The nickel ion concentration in the plating bath generally will be from about 10 to about 150 g/L.

The plating baths of the invention generally will contain one or more conducting salts such as sodium chloride, sodium fluoride, sodium sulfate, potassium chloride, potassium fluoride, potassium sulfate and ammonium chloride, ammonium fluoride and ammonium sulfate. The conductive salts may be present in the plating baths in amounts ranging from about 50 to about 300 g/L or more. Boric acid may be included in the acid zinc-nickel plating baths of the present invention to serve as a weak buffer to control the pH and the cathode film. The boric acid also may be helpful in smoothing the deposit and is believed to have a cooperative effect with the leveling agents of the invention. The concentration of boric acid in the bath is not critical and generally will be in the range of up to about 60 g/L.

Polymeric sulfur-containing compositions have been found to be useful for extending the brightness range and improving the properties of the zinc-nickel alloys deposited from the plating baths of the present invention. Useful polymeric sulfur-containing compositions characterized by the following general formulae $$RS(R'O)_nH \quad (I)$$

or $$S—[(R'O)_nH]_2 \quad (II)$$

wherein R is an alkyl group containing up to about 24 carbon atoms, each R' is independently an alkylene group containing 2 or 3 carbon atoms, and each n is independently an integer of from 1 to about 100. The compositions according to Formula I can be prepared by reacting a mercaptan with an excess of ethylene or propylene oxide or mixtures of such oxides. An alkaline catalyst generally is used in promoting the condensation reaction. Examples of alkaline catalysts include alkali metal hydroxides, oxides and alcoholates. The preparation of compounds represented by Formula I is described in more detail in U.S. Pat. No. 2,494,610 which disclosure is hereby incorporated by reference.

Compounds of the type represented by Formula II can be prepared by reacting one mole of hydrogen sulfide, 2-hydroxyethyl sulfide or 3-hydroxypropyl sulfide with from 1 to 100 moles of ethylene or propylene oxide or mixtures of such oxides. Preferably, an excess of the oxide and an alkaline catalyst can be employed.

In one preferred embodiment, the sulfur-containing composition is derived from one mole of hydrogen sulfide or 2-hydroxyethyl sulfide and up to 100 moles of ethylene oxide. In another embodiment, the hydrogen sulfide is replaced by a mercaptan containing 6 to 24 carbon atoms.

Polymeric sulfur-containing compositions of the type useful in the plating baths of the present invention also are available from GAF under the general trade designation "PEGOL TDG" and from the Alcolac Company under the general trade designation "SIPONIC". For example, PEGOL TDG 1250 is the product obtained by ethoxylating 2-hydroxyethyl sulfide with about 30 moles of ethylene oxide.

The amount of polymeric sulfur-containing composition included in the acidic zinc-nickel plating baths of the invention is an amount sufficient to provide a level and bright nickel alloy deposit. Generally, the baths of the invention will contain from about 1 to about 30 g/L of the polymeric sulfur-containing compositions.

The plating baths of the present invention also contain a ductility-improving amount of at least one acetylenic derivative characterized by the following general formula $$R_1C{\equiv}CCH_2OR_2 \quad (III)$$

wherein $R_1$ is selected from H,$CH_2OH$ and $CH_2OR_2$, and $R_2$ is selected from H,$(CH_2CH_2O)_nH$, $(CH_2—CH(OH)CH_2)_nH$, $(CH_2)_mSO_3M$, $(CH_2CH(OH)—CH_2)_nSO_3M$, $(CH_2CH_2O)n(CH_2CH(OH)CH_2)_m—SO_3M$, and $(CH_2CH_2O)_n(CH_2)_mSO_3M$, wherein n is an integer of from 1 to 10; m is an integer of from 1 to 4; and M is selected from hydrogen, ammonium, or alkali metal provided that $R_1$ is not H when $R_2$ is H, $(CH_2CH_2O)_nH$ or $(CH_2CH(OH)CH_2)_nH$. These compounds are lower molecular weight acetylenic alcohols and diols, and their epoxide adducts, their sulfonated adducts and their alkyl ether sulfonic acid derivatives.

In a preferred embodiment, the acetylenic derivatives are obtained by sulfonating the intermediate which is obtained by (D-1) reacting an acetylenic alcohol or diol with a halogenated epoxide; or (D-2) reacting an acetylenic alcohol or diol with an alkylene oxide followed by reaction with a halogenated epoxide. It has been discovered that the presence of such acetylenic derivatives in the acid zinc-nickel plating baths of the present invention results in the deposition of alloys having exceptional ductility. The amounts of the acetylenic derivatives included in the plating baths of the present invention will range from about 0.1 to about 10 g/L.

In one embodiment, the acetylenic derivatives are derived from acetylenic alcohols such as represented by the following formula $$RC{\equiv}CCH_2OH$$

wherein R is hydrogen or a lower alkyl group such as methyl, ethyl, etc. Propargyl alcohol (R=H) is a preferred acetylenic alcohol starting material. In another embodiment, the acetylenic derivatives are derived from acetylenic diols, and more preferably, symmetrical acetylenic diols containing 4, 6 or 8 carbon atoms. Examples of such symmetrical acetylenic diols include: 2-butyne-1,4-diol; 3-hexyne-1,6-diol and 4-octyne-1,8-diol.

The halogenated epoxides which are reacted with the acetylenic alcohols or diols include the chloro-, bromo- and iodo-substituted propylene and butylene compounds. Epichlorohydrin is a particularly preferred halogenated epoxide. The alkylene oxide generally will be ethylene oxide, propylene oxide, butylene oxide, etc.

The intermediates which are produced by the reaction of acetylenic alcohol or diol with a halogenated epoxide contains chlorine, and the intermediate is sulfonated to substitute a sulfonic acid group for the halogen group. The reaction between the acetylenic alcohol or diol and the halogenated epoxide may be catalyzed by boron trifluoride or similar Lewis acid catalyst.

The reactions of symmetrical acetylenic diols with epichlorohydrin or with alkylene oxides followed by reaction with a halogenated epoxide are described in U.S. Pat. Nos. 3,699,016; 3,860,638; and 3,907,876, the disclosures of which are hereby incorporated by reference.

Specific examples of useful acetylenic derivatives are shown in the following Table I. Some of the materials are readily available commercially while others can be prepared as described above and by procedures described in detail in the above-identified patents.

TABLE I

| Example | Structure |
|---|---|
| Gamma-propynoxy, propyl sulfonic acid | $HC{\equiv}CCH_2O(CH_2)_3SO_3H$ |

TABLE I-continued

| Example | Structure |
|---|---|
| Gamma-propynoxy, beta-hydroxy propyl sulfonic acid | $H{\equiv}CCH_2OCH_2\overset{\overset{\displaystyle CH_2SO_3H}{\vert}}{C}HOH$ |
| 2-Butyn-1,4-diol | $HOCH_2C{\equiv}CCH_2OH$ |
| Bis-beta-hydroxyethyl ether 2-butyn-1,4-diol | $HOCH_2CH_2OCH_2C{\equiv}CCH_2OCH_2CH_2OH$ |
| Bis-beta-hydroxypropyl ether 2-butyn-1,4-diol | $HOC(CH_3)HCH_2OCH_2C{\equiv}CCH_2OCH_2C(CH_3)HOH$ |
| 1(gamma-sulfopropoxy)-2-butyn-4-ol | $HOCH_2C{\equiv}OCH_2O(CH_2)_2SO_3H$ |
| 1,4-di(beta-hydroxy-gamma-sulfonic propoxy)-2-butyne | $HO_3S\overset{\overset{\displaystyle HO}{\vert}}{C}H_2CH_2OCH_2C{\equiv}CCH_2OCH_2\overset{\overset{\displaystyle CH_2SO_3H}{\vert}}{C}HOH$ |
| 1,6-di(beta-hydroxy-gamma-sulfonic propoxy)-3-hexyne | $HO_3S\overset{\overset{\displaystyle HO}{\vert}}{C}H_2CH_2OCH_2C{\equiv}CCH_2OCH_2\overset{\overset{\displaystyle CH_2SO_3H}{\vert}}{C}HOH$ |
| 1,8-di(beta-hydroxy-gamma-sulfonic propoxy)-4-octyne | $HO_3S\overset{\overset{\displaystyle HO}{\vert}}{C}H_2CH_2OCH_2C{\equiv}CCH_2OCH_2\overset{\overset{\displaystyle CH_2SO_3H}{\vert}}{C}HOH$ |

In the above Table I, it should be understood that water-soluble salts of the sulfonic acid derivatives can be substituted. As mentioned above, the hydroxy-containing sulfonic acid or sulfonic acid salt derivatives such as those illustrated in Examples 6 and 10–12 are preferred.

The brightness of the zinc-nickel alloy deposited from the aqueous acidic plating baths containing the polymeric sulfur-containing compositions and the acetylenic derivatives described above is improved when the bath also contains at least one carbonyl-containing compound such as aromatic and olefinic aldehydes, ketones, carboxylic acids and salts of carboxylic acids. The supplementary brighteners impart optimum leveling action over a wide current density range. The following compounds illustrate the types of carbonyl-containing compounds which are useful as brighteners in the plating baths of the invention, and these carbonyl compounds include aldehydes, ketones and carboxylic acids, esters and salts, particularly olefinic and carboxylic acids, esters and salts thereof: ortho-chlorobenzaldehyde, para-chlorobenzaldehyde, o-hydroxybenzaldehyde, aminobenzaldehyde, veratraldehyde, benzylidene acetone, coumarin, 3,4,5,6-tetrahydrobenzaldehyde, acetophenone, propiophenone, furfurylidene acetone, 3-methoxybenzal acetone, benzaldehyde, vanillin, hydroxybenzaldehyde, anisicaldehyde, benzoic acid, sodium benzoate, sodium salicylate, 3-pyridine carboxylic acid (nicotinic acid), methacrylic acid, methyl methacrylate, sodium methacrylate, etc. Mixtures of one or more of the acids with one or more ketones also are useful. When employed in the baths of the invention, the carbonyl-containing brighteners will be included within the range of from about 0.02 to about 5 g/L.

Aromatic sulfonic acids or salts also are useful additives to the plating baths and these include the acids and salts having the general formula

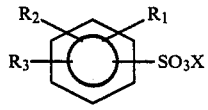

(IV)

or

-continued

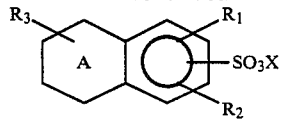

(V)

wherein $R_1$, $R_2$ and $R_3$ are each independently hydrogen or lower alkyl groups; X is hydrogen, ammonium or any metal with the proviso that the metal sulfonate is soluble in the plating bath and A is a saturated, unsaturated or aromatic ring. As can be seen from the formulae, the sulfonic acids may be derived from benzene sulfonic acids, naphthalene sulfonic acids and di- or tetrahydronaphthalene sulfonic acids. The lower alkyl groups may be straight or branched chain and may contain up to about 6 carbon atoms. The aromatic sulfonic acids and salts of Formulae IV and V containing two alkyl groups have been found to be particularly effective in the acid zinc plating baths of the invention. Of the metals included in the salts of the sulfonic acids, the alkali metals, particularly sodium, are preferred.

Examples of aromatic sulfonic acids which are useful in the acid plating baths of the invention include benzene sulfonic acid, toluene sulfonic acid, isopropylbenzene sulfonic acid, xylene sulfonic acid, diethylbenzene sulfonic acid, naphthalene sulfonic acid, methylnaphthalene sulfonic acid, dimethylnaphthalene sulfonic acid, tetrahydronaphthalene sulfonic acid, etc. The aromatic sulfonic acids preferably are added to the acid zinc-nickel plating baths in the form of their salts which may be metal salts or an ammonium salt. Any metal can be used to form the metal salts of the aromatic sulfonic acids so long as the metal does not cause any detrimental effects in the plating bath or render the sulfonates insoluble in the plating bath.

The aromatic sulfonic acids and salts which are utilized in the aqueous acid plating baths of the invention generally are referred to in the art as hydrotropes. Hydrotropes have been defined as compounds which solubilize sparingly water-soluble compounds. The aromatic sulfonic acids and salts used in the present invention are effective in solubilizing sparingly water-soluble materials such as aromatic carbonyl-containing compounds, and it has been found that the acid zinc-nickel plating baths containing the above-described aromatic sulfonic acids and salts are not subject to eccessive foaming during plating operations. This is in contrast to plating baths wherein wetting agents and surfactants are used to stabilize the baths since such plating baths generally are characterized by excess foaming on use with requires careful control of plating methods. The acid plating baths of the invention, however, can be vigorously air agitated even at high current densities without excessive foaming.

The amount of aromatic sulfonic acid or salt incorporated into the acid plating baths of the invention may vary over a wide range, and the optimum amount for any particular acid zinc-nickel plating bath combination can be determined readily by one skilled in the art. Generally, the amount of sulfonic acid or salt included in the plating baths of the invention will vary from about one to about 30 or more grams per liter of bath. Greater or lesser amounts of the sulfonic acid or salts can be included in the plating baths depending particularly on the water-solubility characteristics of the additive desired to be included in the bath.

Mixtures of the aromatic sulfonic acids or salts appear to be particularly effective in the acid plating baths of the invention. More particularly, mixtures comprising at least one sulfonic acid or salt represented by Formula IV and at least one sulfonic acid or salt represented by Formula V are useful. An example of such a mixture is a mixture of sodium dimethylnaphthalene monosulfonate and sodium xylene monosulfonate.

The inclusion of the aromatic sulfonic acids and salts described above in acid zinc-nickel plating baths generally improves the performance of most acid plating baths at a high current density range. Accordingly, the plating baths containing the sulfonic acids and salts produce bright level zinc-nickel plating over a current density range of from below 0.3 amps/dm$^2$ to above 12 amps/dm$^2$.

The properties of the zinc-nickel alloy deposited from the aqueous acidic plating baths of the invention may be enhanced further by including in the bath, small amounts of at least one anionic aromatic sulfonic acid or salt thereof. These compounds are obtained by the polycondensation of formaldehyde and an aromatic sulfonic acid which generally is a naphthalene sulfonic acid. Polycondensation products of this type are known compounds and their production has been described in the literature such, for example, Houben-Weyl, "Methoden Der Organishen Chemie", Vol. XIV/2 at page 316, and said description is hereby incorporated by reference. The utility of these condensation products in acid zinc baths is described in U.S. Pat. Nos. 3,878,069 and 4,075,066.

Polycondensation products of these types are available commercially from GAF under the general trade designations BLANCOL N and BLANCOL DISPERSANT; from BASF under the designation TAMOL NNO; from Kokko Corporation under the designation DEMOL N; and from Stepan Chemical Company under the designation STEPANTAN A. These condensation products are included in the baths of the present invention in amounts which may be varied depending upon other ingredients in the plating bath, and generally, the amounts which improve the brightness is from about 0.1 to about 15 g/L of plating bath.

The acidic zinc-nickel plating baths of the present invention also may be improved by the incorporation therein of small amounts of bath-soluble metal salts of the sulfate ester of 2-ethyl-1-hexanol. These sodium salts are available commercially from a number of vendors including, for example, Niaset Corporation under the designation NIAPROOF 08; The Henkel Chemicals Company (Canada) under the designation SULFOTAX CA; from BASF under the trade designation LUGALVAN TC-EHS; etc. From about 0.1 to about 15 g/L of these salts can be included in the plating baths of the present invention.

The acid zinc-nickel plating baths of the present invention deposit a level, bright and ductile zinc-nickel alloy on substrates at any conventional temperature such as from about 25° C. to about 60° C. Still plating baths generally will be operated at a lower range of the temperature such as from about 25° C. to about 40° C. whereas high-speed plating baths for strip or wire-plating may be operated over the entire range of from about 25° C. to about 60° C.

The following Examples 1–3 illustrate typical acidic zinc-nickel plating baths to which various additive compositions are added in accordance with the present invention.

EXAMPLE 1

| | |
|---|---|
| Zinc Chloride | 100 g/L |
| Nickel Chloride | 155 g/L |
| Ammonium Chloride | 240 g/L |
| Concentrated Ammonium Hydroxide Solution | 75 g/L |
| pH | 5.8 |

EXAMPLE 2

| | |
|---|---|
| Zinc Chloride | 35 g/L |
| Nickel Sulfate | 102 g/L |
| Ammonium Chloride | 120 g/L |
| Concentrated Ammonium Hydroxide Solution | 40 g/L |
| pH | 6.0 |

EXAMPLE 3

| | |
|---|---|
| Zinc Chloride | 35 g/L |
| Nickel Sulfate | 102 g/L |
| Ammonium Chloride | 125 g/L |
| Fluoboric Acid | 3.8 mL/L |
| Ammonium Hydroxide | 35 g/L |
| pH | 5.5 |

Examples A–D illustrate the aqueous acidic zinc-nickel plating baths of the present invention. The utility of the plating baths of the invention also is demonstrated by plating steel Hull Cell panels in a 267 mL Hull Cell.

Example A—Bath of Example 1 to which is added:

| | |
|---|---|
| Sodium Xylene Sulfonate | 14 g/L |
| Sodium Benzoate | 6 g/L |
| Sodium 2-Ethylhexylsulfate | 6.4 g/L |
| Tamol NNO | 3 g/L |
| Benzylidene Acetone | 0.2 g/L |
| Pegol TDG 1250 | 6 g/L |
| $HC{\equiv}CCH_2OCH_2CH(OH)CH_2SO_3{-}Na+$ | 5 g/L |

A mirror bright and ductile deposit on a 3 amp, 5 minute Hull Cell panel was obtained at 115° F. with mechanical agitation. The bright deposit was not obtained when the thiodiglycol ethoxylate, Pegol TDG 1250, was omitted from the bath, and the deposit was noticeably less ductile when the acetylenic derivative was omitted as evidenced by bending the panels 180°.

Example B—Bath of Example 1 to which is added:

| | |
|---|---|
| Sodium Toluene Sulfonate | 12 g/L |
| Sodium Methacrylate | 6 g/L |
| Pegol TDG 1250 | 6 g/L |
| Niaproof 08 | 7 g/L |
| Blancol N | 2.8 g/L |
| Benzylidene Acetone | 0.2 g/L |
| $(\equiv CCH_2CH(OH)CH_2SO_3—Na+)_2$ | 0.2 g/L |

A 3 amp, 5 minute Hull Cell panel run at 120° F. with mechanical agitation had a mirror-brignt appearance across the entire panel and the deposit was more ductile than a deposit from a similar bath which did not contain the acetylenic derivative.

Example C—Bath of Example 2 to which is added:

| | |
|---|---|
| Ethoxylated 2-Hydroxyethyl-sulfide (21 Ethoxylate) | 24 g/L |
| Sodium Cumeme Sulfonate | 13 g/L |
| Sodium Benzoate | 3 g/L |
| Lugal Van TC-EHS | 2.5 g/L |
| Stepantan A | 3 g/L |
| Vanillidene Acetone | 0.4 g/L |
| Acetylenic Derivative of Example B | 1 g/L |

A 2 amp, 5 minute Hull Cell panel at 120° F. with mechanical agitation was full-bright and ductile.

Example D—Bath of Example 3 to which is added:

| | |
|---|---|
| Ethoxylated 2-Hydroxyethyl Sulfide (21 Ethoxylate) | 20 g/L |
| Sodium Xylene Sulfonate | 14 g/L |
| Sodium 2-Ethyl Hexyl Sulfate | 2.8 g/L |
| Blancol N | 2.8 g/L |
| Benzylidene Acetone | 0.2 g/L |
| Acetylenic Derivative of Example A | 2 g/L |

A 2 amp, 5 minute Hull Cell panel at 110° F. with mechanical agitation was full-bright and ductile.

The percent nickel in the alloy deposit obtained in Examples A–D was 10–12% at all current densities greater than 5 amps/sq. ft. Increasing the temperature to 140° F. in the above examples increases the percent nickel to greater than 18% in the low current density areas and gives a dark electrodeposit. Increasing the amount of nickel in the bath, while maintaining the amount of zinc constant, will increase the precentage of nickel in the electrodeposit. Likewise, decreasing the amount of nickel, while maintaining the zinc constant, will decrease the amount of nickel in the electrodeposit.

The following examples illustrate additive compositions or concentrates which may be prepared and utilized in accordance with the invention for preparing or maintaining the baths of the invention and/or improving the performance of the baths of the invention.

Additive Composition 1

| | |
|---|---|
| Pegol TDG 1250 | 20–60 g/L |
| Sodium Xylene Sulfonate | 50–150 g/L |
| Sodium Benzoate | 50–150 g/L |
| Sodium 2-Ethylhexyl Sulfate | 50–150 g/L |
| Acetylenic Derivative from Example B | 5–15 g/L |
| Water to | 1 liter |

-continued

Additive Composition 2

| | |
|---|---|
| Pegol TDG 1250 | 30–50 g/L |
| Blancol N | 5–20 g/L |
| Sodium Xylene Sulfonate | 50–150 g/L |
| Benzylidene Acetone | 50–150 g/L |
| Methanol | 200–400 g/L |
| Water to | 1 liter |

Additive Composition 3

| | |
|---|---|
| Ethoxylated 2-Hydroxyethyl sulfide (21 Ethoxylate) | 50–200 g/L |
| Benzylidene Acetone | 50–150 g/L |
| Methanol | 200–500 g/L |
| Water to | 1 liter |

A liter bath with the composition of bath Example 1 is prepared, and 50 mL of Additive Composition 1 and 1 mL of Additive Composition 2 are added and test panels are run continuously at 2.7 amps at 120° F. with air agitation. Additive Composition 3 is added at a rate of 1 mL every 8 amp hours. Representative panels continue to be plated with a full bright and ductile electrodeposit containing approximately 12% nickel.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

I claim:

1. An aqueous acidic plating bath for the electrodeposition of a zinc-nickel alloy coating on a substrate which comprises (A) zinc ions;

(B) nickel ions;

(C) an amount, sufficient to provide a level and bright zinc-nickel alloy electrodeposit, of at least one polymeric sulfur-containing compound having the general formula $$RS(R'O)_nH \quad (I)$$

or $$S—[(R'O)_nH]_2 \quad (II)$$

wherein R is an alkyl group containing up to about 24 carbon atoms, each R′ is independently an alkylene group containing 2 or 3 carbon atoms, and each n is independently an integer of from 1 to about 100; and (D) a ductility-improving amount of at least one acetylenic derivative obtained by sulfonating an intermediate obtained by (D-1) reacting an acetylenic alcohol or diol with a halogenated epoxide; or (D-2) reacting an acetylenic alcohol or diol with an alkylene oxide followed by reaction with a halogenated epoxide.

2. The acid plating bath of claim 1 wherein the concentration of zinc ion and nickel ions in the bath are sufficient to deposit a zinc-nickel alloy containing from about 4% to about 18% by weight of nickel.

3. The plating bath of claim 1 wherein the polymeric sulfur-containing compound is prepared by reacting one mole of hydrogen sulfide or 2-hydroxyethyl sulfide with up to about 100 moles of ethylene oxide or propylene oxide.

4. The acid plating bath of claim 1 wherein the halogenated epoxide in (D-1) and (D-2) are halogenated propylene or butylene oxides.

5. The acid plating bath of claim 1 wherein the acetylenic alcohol in (D-1) and (D-2) is characterized by the formula $$R'—C\equiv C—CH_2OH \quad \text{(III)}$$

wherein R' is hydrogen or an alkyl group.

6. The acid plating bath of claim 1 wherein the acetylenic diol in (D-1) and (D-2) is a symmetrical acetylenic diol containing 4, 6 or 8 carbon atoms.

7. The acid plating bath of claim 1 wherein the alkylene oxide in (D-2) is ethylene oxide, propylene oxide or butylene oxide.

8. The acid plating bath of claim 1 also containing chloride ions.

9. The acid plating bath of claim 1 also containing at least one aromatic or olefinic carbonyl-containing compound.

10. The acid plating bath of claim 9 wherein the aromatic carbonyl-containing compound is an aromatic aldehyde, ketone or carboxylic acid, or bath-soluble salt of an aromatic carboxylic acid.

11. The acid plating bath of claim 9 wherein the aromatic carbonyl-containing compound comprises a mixture of a bath-soluble salt of benzoic acid and an aromatic ketone.

12. The acid plating bath of claim 1 wherein the bath also contains at least one aromatic sulfonic acid or salt thereof having the general formula

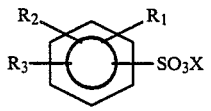

(IV)

or

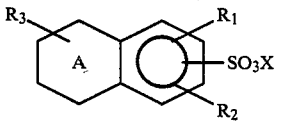

(V)

wherein $R_1$, $R_2$ and $R_3$ are each independently hydrogen or lower alkyl groups; X is hydrogen, ammonium or any metal with the proviso that the metal sulfonate is soluble in the plating bath and A is a saturated, unsaturated or aromatic ring.

13. The acid plating bath of claim 12 wherein the alkyl groups are straight or branched chain alkyl groups containing up to about 6 carbon atoms.

14. The acid plating bath of claim 1 wherein the bath also contains at least one anionic aromatic sulfonic acid condensate or salt thereof.

15. The acid plating bath of claim 14 wherein the sulfonic acid condensate is obtained by the polycondensation of formaldehyde and an aromatic sulfonic acid.

16. A method of electrodepositing a bright and ductile zinc-nickel alloy coating on a substrate which comprises electroplating said substrate in an aqueous acidic zinc bath in accordance with claim 1.

17. An aqueous acidic plating bath for the electrodeposition of a zinc-nickel alloy coating on a substrate which comprises (A) zinc ions;

(B) nickel ions;

(C) from about 1 to about 30 g/L of at least one polymeric sulfur-containing compound having the general formula $$S—[(R'O)_nH]_2 \quad \text{(II)}$$

wherein R'is an alkylene group containing 2 or 3 carbon atoms, and n is an integer of from 1 up to about 100;

(D) from about 0.1 to about 10 g/L of at least one acetylenic deivative obtained by sulfonating the intermediate obtained by (D-1) reacting an acetylenic alcohol or diol with epichlorohydrin, or (D-2) reacting an acetylenic alcohol or diol with ethylene oxide, propylene oxide or butylene oxide followed by reaction with epichlorohydrin;

(E) from about 0.02 to about 5 g/L of an aromatic or olefinic carbonyl-containing compound selected from the group consisting of aromatic aldehydes, ketones or carboxylic acids or bath-soluble salts of aromatic carboxylic acids;

(F) from about 1 to about 30 g/L of at least one aromatic sulfonic acid or salt thereof having the general formula

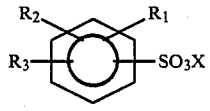

(IV)

or

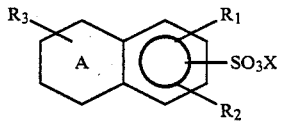

(V)

wherein $R_1$, $R_2$ and $R_3$ are each independently hydrogen or straight or branched chain alkyl groups containing up to about 6 carbon atoms; X is hydrogen, ammonium or any metal with the proviso that the metal sulfonate is soluble in the plating bath.

18. The acid plating bath of claim 17 wherein the intermediate (D-1) is obtained by reacting a symmetrical acetylenic diol containing 4, 6 or 8 carbon atoms with epichlorohydrin.

19. The acid plating bath of claim 17 wherein the aromatic carbonyl-containing compound (E) comprises a mixture of a bath-soluble metal salt of benzoic acid and an aromatic ketone.

20. The acid plating bath of claim 17 also containing from about 0.1 to about 15 g/L of at least one anionic sulfonic acid-formaldehyde condensate or bath-soluble salt thereof.

21. The acid plating bath of claim 17 also containing at least one nonionic, cationic or amphoteric ethylene oxide condensate surfactant.

22. A method of electrodepositing a bright and ductile zinc-nickel alloy coating on a substrate which comprises electroplating said substrate in an aqueous acidic zinc bath in accordance with claim 17.

23. Aqueous additive compositions for aqueous acidic zinc-nickel plating baths comprising water, from about 20 to about 60 g/L of at least one polymeric sulfur-containing compound having the general formula $$RS(R'O)_nH \quad (I)$$

or $$S—[(R'O)_nH]_2 \quad (II)$$

wherein R is an alkyl group containing up to about 24 carbon atoms, each R' is independently an alkylene group containing 2 or 3 carbon atoms, and each n is independently an integer of from 1 to about 100;

from about 5 to about 15 g/L of at least one acetylenic derivative obtained by sulfonating the intermediate obtained by (D-1) reacting an acetylenic alcohol or diol with a halo epoxide; or (D-2) reacting an acetylenic alcohol or diol with an alkylene oxide followed by reaction with a halo epoxide, from 50 to about 150 g/L of at least one aromatic sulfonic acid or water-soluble salt thereof, and about 50 to about 150 g/L of at least one aromatic carbonyl-containing compound.

* * * * *